US005232339A

United States Patent [19]

Plemmons et al.

[11] Patent Number: 5,232,339

[45] Date of Patent: Aug. 3, 1993

[54] FINNED STRUCTURAL DISK SPACER ARM

[75] Inventors: Larry W. Plemmons, Fairfield; Richard A. Wesling, Cincinnati, both of Ohio

[73] Assignee: General Electric Company, Cincinnati, Ohio

[21] Appl. No.: 826,732

[22] Filed: Jan. 28, 1992

[51] Int. Cl.[5] ..... F01D 5/08

[52] U.S. Cl. ..... 415/178; 415/177; 415/199.5; 416/198 A

[58] Field of Search ..... 415/115, 116, 177, 178, 415/199.5; 416/95, 198 A, 201 R; 301/6 CS

[56] References Cited

U.S. PATENT DOCUMENTS

| | | | |
|---|---|---|---|
| 2,298,333 | 10/1942 | Ash et al. | 301/6 CS |
| 2,868,439 | 1/1959 | Hampshire et al. | 415/199.5 |
| 2,875,948 | 3/1959 | Stalker | 415/199.5 |
| 2,889,173 | 6/1959 | Miller | 301/6 CS |
| 3,056,579 | 10/1962 | Bobo . | |
| 3,074,688 | 1/1963 | De Muth et al. | 415/177 |
| 3,647,313 | 3/1972 | Koff . | |
| 3,742,706 | 7/1973 | Klompas | 415/115 |
| 3,800,864 | 4/1974 | Hauser et al. . | |
| 4,127,357 | 11/1978 | Patterson | 415/177 |
| 4,213,738 | 7/1980 | Williams . | |
| 4,231,704 | 11/1980 | Ayache et al. . | |
| 4,320,903 | 3/1982 | Ayache et al. | 415/178 |
| 4,541,775 | 9/1985 | Hovan | 416/95 |
| 5,157,914 | 10/1992 | Schwarz et al. | 415/115 |

OTHER PUBLICATIONS

Introduction to Stress Analysis, by Charles O. Harris, 1959, pp. 250–260, The MacMillan Co.

Formulas for Stress and Strain, by Roark and Young, Fifth Edition, McGraw-Hill Book Co., pp. 564–572.

Theory of Elasticity, by S. Timoshenko, and J. N. Goodier, Engineering Societies Monographs, second edition, pp. 69–73, 1951.

*Primary Examiner*—Edward K. Look

*Assistant Examiner*—James A. Larson

*Attorney, Agent, or Firm*—Jerome C. Squillaro; John R. Rafter

[57] ABSTRACT

A rotor disk assembly includes rotor disks and structural spacer arms adapted to transmit axial loads and bending moments between adjacent disks. The spacer arms include cooling fins for convective cooling of the spacer arms. The spacer arm is preferably a self supporting wheel structure. The cooling fins are preferably circumferentially continuous and extend radially into a relatively cooler rotor bore cavity in which the disk hubs are supported. The cooling fins can be positioned on the spacer arms to reduce thermal distortion of the spacer arms, and thereby reduce bending stresses transmitted to the disks. The spacer arm includes a body section adjacent a relatively higher temperature seal cavity, which can be purged by cooling air from the relatively lower temperature rotor bore cavity. The temperature differential between the body section and the cooler fin tips results in transfer of centrifugal hoop loads to the cooling fins, thereby reducing the loads in the spacer arm body section and the amount of cooling air required to purge the higher temperature seal cavity.

18 Claims, 5 Drawing Sheets

FINNED STRUCTURAL DISK SPACER ARM

TECHNICAL FIELD

The present invention is related to structural rotor disk spacer arms in gas turbine engines, and more particularly, to a finned structural disk spacer arm arrangement, wherein the finned disk spacer arm is preferably a self-supporting wheel structure.

BACKGROUND OF THE INVENTION

Rotor constructions in gas turbine engines can include a plurality of blade carrying rotor disks separated by annular disk spacer arms. U.S. Pat. No. 3,647,313, assigned to the General Electric Company, discloses a compressor rotor structure with disks separated by annular spacer arms, and a system for cooling the rotor construction. It is desirable to minimize the amount of cooling air used to cool rotors and spacer arms in order to increase engine cycle efficiency.

U.S. Pat. No. 3,056,579, assigned to the General Electric Company, discloses a composite disk structure having a first catenary-shaped portion performing a heat shield function, and a second axially aligned stiffening member, which can have a cylindrical spacer form. Cooling fins are shown positioned on the catenary heat shield. However, the finned heat shield of U.S. Pat. No. 3,056,579 can introduce performance penalties in practice. Centrifugal loads as well as heat and pressure induced loads generated in the catenary shield are transferred to the disk rims (as discussed in Col. 3, line 63–66). This load transfer to the disk rim is due to the fact that the catenary shield is, by design, not a self supporting wheel structure capable of carrying its own centrifugally induced loads. Therefore, the added centrifugal loads due to the added weight of the fins on the catenary shield increase the disk rim stress by increasing the centrifugal load transmitted to the disk rims. Thus, the added fins on a structure which is not a self-supporting wheel structure can require extra cooling air or disk rim material to maintain disk rim stresses at an allowable level for a given operating temperature. The added weight of the fins will also increase the hoop stress in the catenary shield.

Further, fins positioned on the heat shield do not effectively reduce thermal distortions in the structural disk spacer arm, and the resultant stresses in the spacer arm and adjacent disks. Temperature gradients in the disk spacer arms distort disk spacer arms and can result in detrimental bending stresses in the spacer arms and adjacent disk rims where the spacer arms transmit bending loads between adjacent disks, especially during transient operating conditions where the spacer arms respond to temperature changes more quickly then adjacent disks or connecting flanges.

Additionally, gas turbine engineers seek to increase turbine operating temperatures for improved engine efficiency, while maintaining turbine component temperatures within allowable limits with a minimal amount of cooling air.

ADVANTAGES OF THE INVENTION

Accordingly, one advantage of the present invention is a reduction in the amount of cooling air required to cool a rotor disk assembly.

Another advantage of the present invention includes reduction of thermally induced distortions in structural disk spacer arms.

Another advantage of the present invention is a reduction in bending stresses in the spacer arms and adjacent disk rims.

Additionally, a finned structural disk spacer arm can be provided having fins extending into a lower temperature cooling air cavity in which the rotor hubs are supported.

Still another advantage of the present invention is a disk spacer arm cooled without centrifugally loading the disk rim to which the spacer arm is attached.

Further, spacer arm cooling fins can be provided to run cooler than the rest of a self-supporting disk spacer arm, the fins thereby carrying a portion of the centrifugal hoop load that would otherwise be carried by the outer body section of the spacer arm, thereby raising the temperature capability of the outer body section of the spacer arm and reducing the amount of cooling air required in a cavity outboard of the spacer arm.

SUMMARY OF THE INVENTION

A structural disk spacer arm for a gas turbine engine is provided with one or more cooling fins on a radially inboard surface of the spacer arm. The structural disk spacer can transmit axial loads and bending moments between adjacent rotor disks. The spacer arm is preferably a self supporting wheel structure such that wheel loads centrifugally generated in the spacer arm during maximum engine operating speeds are carried locally by the spacer arm, and are not reacted at the adjacent rotor disk rims. The cooling fins are preferably circumferentially continuous to provide a load path for tensile hoop loads. The fins can extend into a relatively cool rotor bore cavity to run cooler than the rest of the spacer arm structure. The cooler fins tend to shrink relative to the rest of the spacer arm, and are preferably spaced on the disk spacer arm to reduce spacing arm thermal distortion and disk rim stresses caused by such spacer arm distortion. Further, by designing circumferentially continuous fins to run cooler than the rest of the spacer arm, the fins are placed in hoop tension and carry a larger portion of the tensile centrifugal hoop loads that would otherwise be carried by the hotter outer body section of the spacer arm. Thus, by reducing the loads and stress in the outer body section of the spacer arm, the temperature capability of of the outer body section of the spacer arm is increased, and for a given turbine operating temperature, less cooling air for cooling the spacer arm is required in a cavity outboard of the spacer arm.

DESCRIPTION OF A PREFERRED EMBODIMENT

Figure 1:
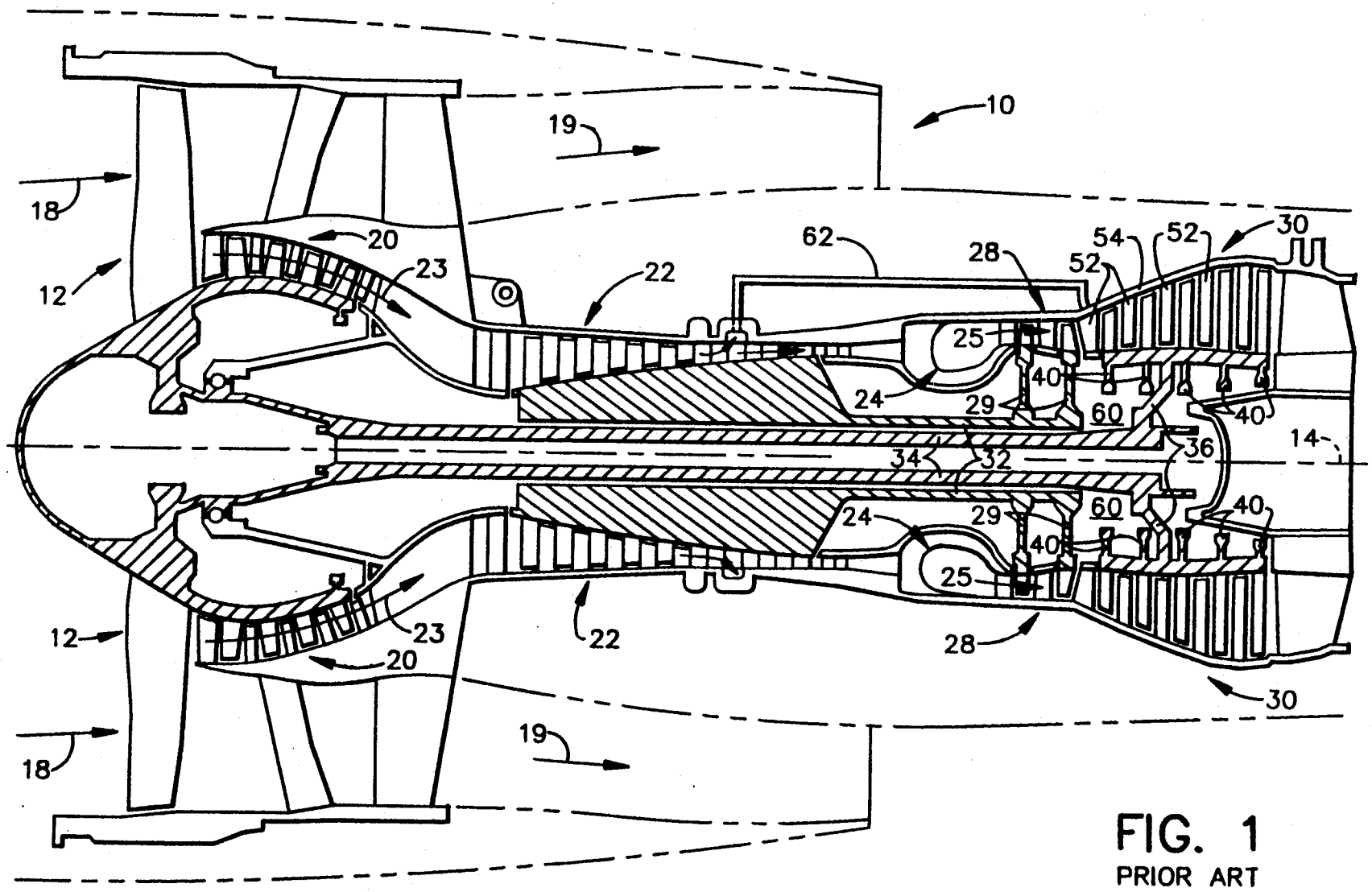
FIG. 1 PRIOR ART
FIG. 1 is a longitudinal cross-sectional schematic illustration of a known high bypass gas turbine engine.

FIG. 1 illustrates a known high bypass gas turbine engine 10. Although shown in cross section, those skilled in the art will appreciate the disclosed axial flow machine extends circumferentially about engine axis 14. The engine 10 includes a fan 12 for receiving an airflow 18. Disposed downstream of fan 12 are a low pressure compressor (LPC) 20, a high pressure compressor (HPC) 22, a combustor 24, a high pressure turbine (HPT) 28 and a low pressure turbine (LPT) 30. Shaft 32 connects high pressure turbine 28 to high pressure compressor 22, while shaft 34 connects low pressure turbine 30 to low pressure compressor 20 and fan 12. The fan 12, compressors 20 and 22, and turbines 28 and 30 are mounted for rotation about a common engine axis 14 in a manner well known in the art. A portion of airflow 18 exiting fan 12 forms fan bypass flow 19 for providing the major propulsive thrust of engine 10. The remainder of airflow 18 forms a core flow 23 which is compressed in turn by compressors 20 and 22. A portion of the core flow 23 exiting the HPC 22 is burned with fuel in combustor 24 to form a high temperature gas flow 25. High temperature gas flow 25 is expanded through HPT 28 and through LPT 30. The expansion of gas flow 25 in turbines 28 and 30 drives compressors 22 and 20 through shafts 32 and 34, respectively.

Figure 2:
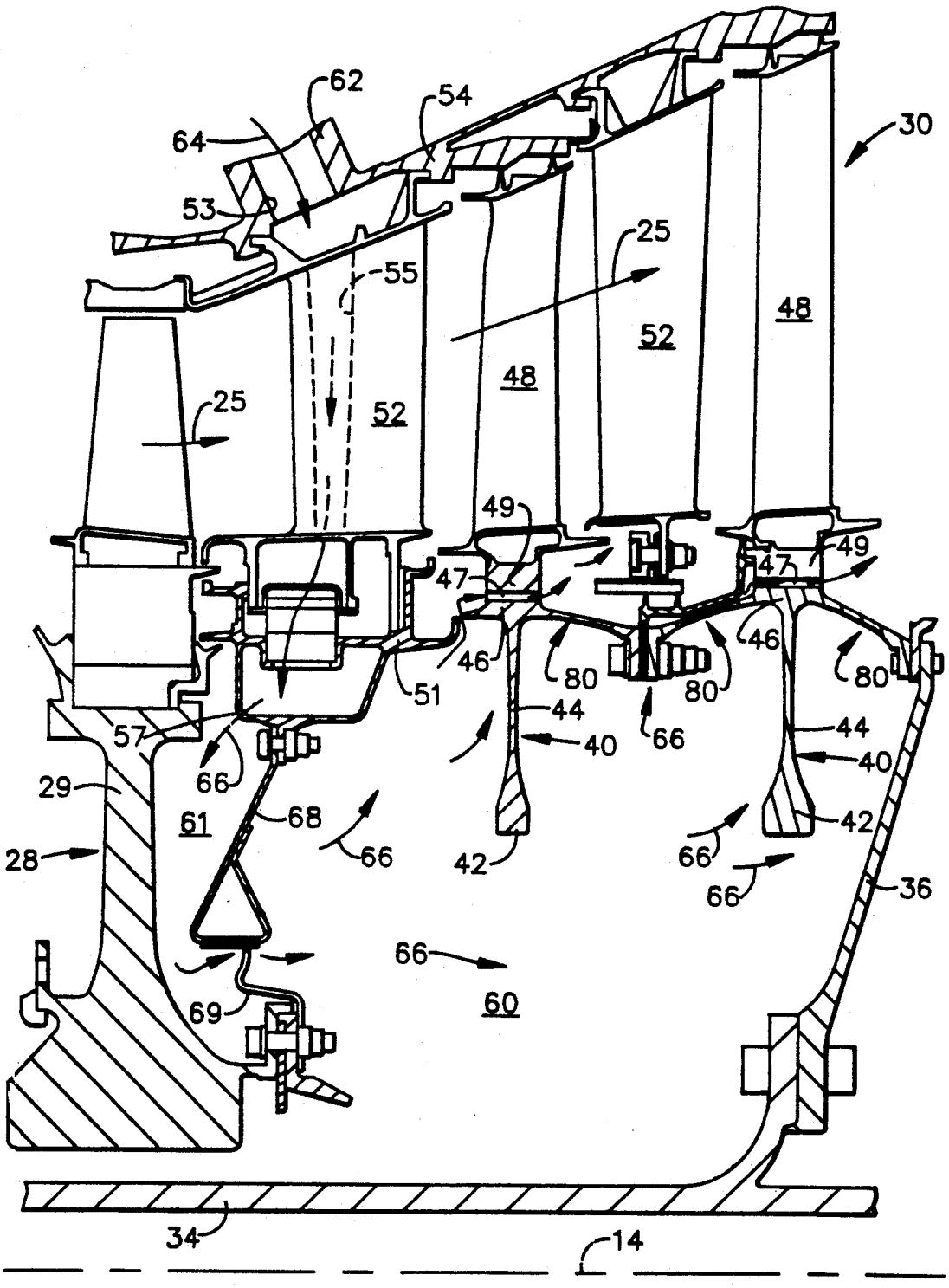
FIG. 2 PRIOR ART
FIG. 2 is an illustration of an enlarged view of a portion of the schematic illustration of FIG. 1, showing portions of the high and low pressure turbine sections.

FIG. 2 is an enlarged schematic illustration of a portion of engine 10 shown in FIG. 1, showing a downstream portion of HPT 28 and an upstream portion of LPT 30. LPT 30 can include a plurality of rotor disks 40 supported from shaft 34 through shaft extension 36. Each rotor disk can include a hub 42 extending radially inwardly into a bore cooling cavity 60, a web 44 extending radially outwardly from the hub 42, and a rim 46 extending radially outwardly from the web 44 to form the perimeter of the rotor disk 40. Adjacent rotor disks 40 are interconnected by structural disk spacer arms 80, which support adjacent rotor disks and transmit axial thrust loads imparted to the disks due to the expansion of gas flow 25 through the LPT. The structural spacer arms can be rigidly attached to, and integral with, an adjacent disk and transmit bending moments between adjacent disks.

Each rotor disk 40 supports a row of blades 48, each blade 48 including a dovetail shaped root portion 49 supported in a shouldered slot 47 in disk rim 46, all in a manner well known in the art. Stationary rows of vanes 52 extend radially inwardly from case 54 intermediate the rows of rotating blades 48.

LPT rotor disks 40 can be cooled by air bled from an upstream compressor. A conduit or pipe 62 (FIG. 1) can carry a portion of core air flow 23 bled from the HPC to an opening 53 in case 54 surrounding the low pressure turbine 30. The bled air, labeled 64 in FIG. 2, is relatively low temperature with respect to higher temperature gas flow 25. Cooling air 64 enters internal passages 55 in vanes 52. Air 64 cools vanes 52, a portion of which is discharged through vane holes into flow 25. A portion of air 64 labeled 66 in FIG. 2 passes through apertures 57 in a stationary vane inner structure 51 to enter a n annular chamber 61, which can be bounded upstream by an HPT rotor disk 29, and downstream by stationary annular seal 68 extending radially inward from structure 51. Cooling air 66 passes through a radial clearance between stationary seal 68 and rotating seal 69 supported by HPT 29, and enters bore cooling cavity 60.

Figure 3:
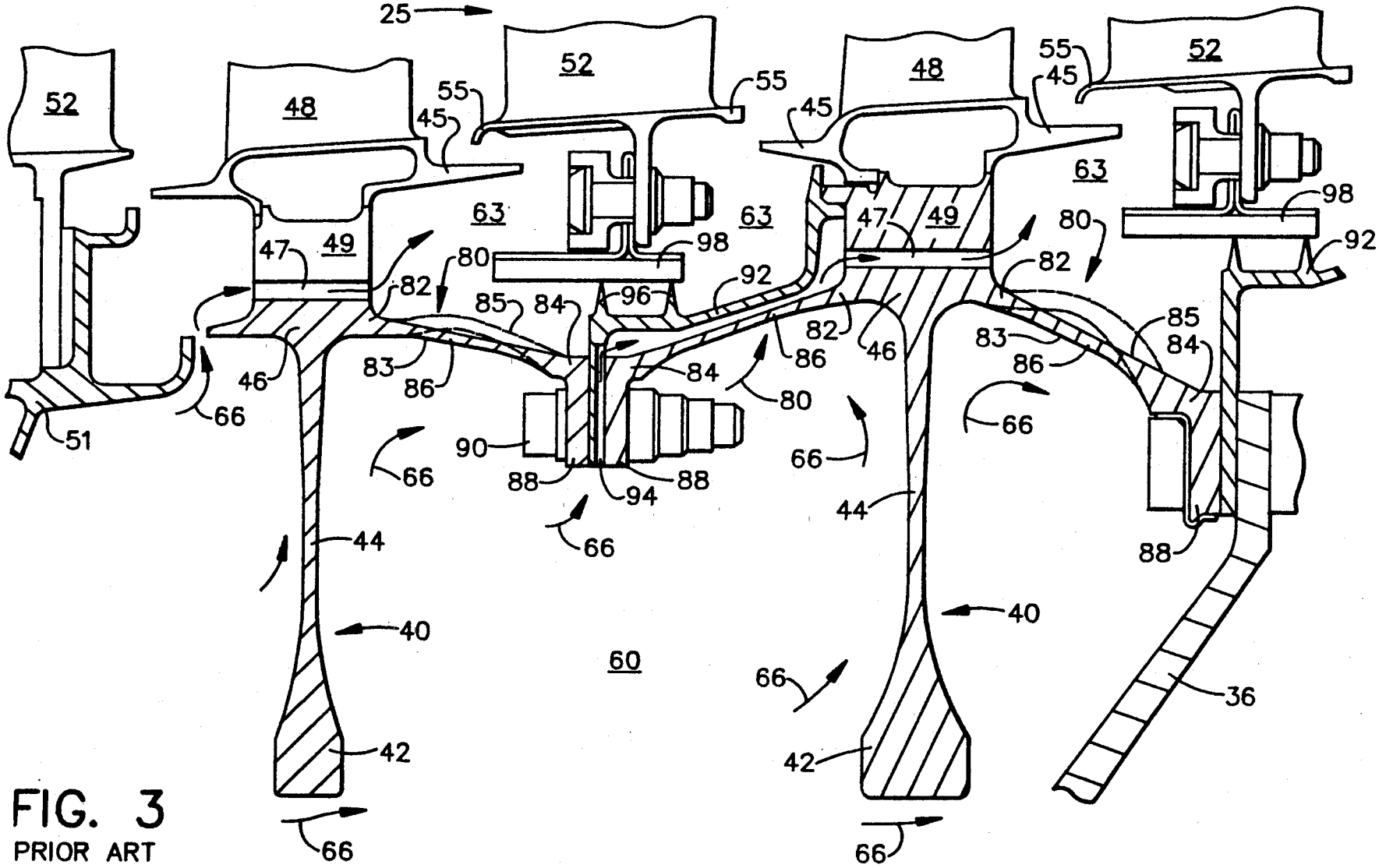
FIG. 3 PRIOR ART
FIG. 3 is an illustration of an enlarged view of a portion of the schematic illustration of FIG. 2, showing adjacent rotor disks separated by disk spacer arms.

Referring to FIG. 3, cooling air 66 in cavity 60 bathes the disk hubs 42 and also cools the disk rims 46 and spacer arm radially inboard surface 83. Annular seal cavities 63 extend circumferentially intermediate flow 25 and spacer arms 80. A portion of cooling air 66 can also be directed as by dovetail slots 47 to flow beneath blade roots 49, thereby cooling the disk rims 46 and purging to some extent seal cavities 63 to reduce ingestion of high temperature gas flow 25 into the circumferentially extending seal cavities 63. Cavities 63 ca be bounded radially outwardly by axially and circumferentially ®extending blade platforms 45 and vane platforms 55, and bounded radially inwardly by radially outboard outer surface 85 on spacer arms 80. Seal cavities 63 are in fluid communication with gas flow 25 through the gap between adjacent rotating blade and stationary vane platforms 45 and 55, respectively. Seal cavities 63 can act as annular buffer cavities intermediate high temperature gas flow 25 and spacer arms 80.

A circumferentially extending seal land 98 bolted to the underside of vane platforms 55 faces rotating seal teeth 96 on circumferentially extending rotating shield 92 to restrict the flow of gases 25 inward of platforms 45 and 55. Shield 92 can be bolted intermediate adjacent disk spacer arms at a bolted connection 90. Shield 92 can include circumferentially spaced radial passages 94 for directing cooling air between shield 92 and a spacer arm 80, and into dovetail slots 47.

Each spacer arm 80 can include a first spacer arm end 82 integral with an adjacent disk rim 46, a second spacer arm end 84 which can include a radially inwardly extending connecting flange 88, and a circumferentially continuous spacer arm body section 86 extending intermediate the first and second ends. Body section 86 can include a radially inboard inner surface 83 and a radially outboard outer surface 85.

Inner spacer arm surface 83 faces cavity rotor bore cavity 60, while outer spacer arm surface 85 faces seal cavity 63. The temperature of the gases in cavity 60 are lower relative to the temperatures of the gases in cavity 63. The portion of relatively cool air 66 that is directed through dovetail slots 47 helps to purge cavities 63 and cool the body section 86 of spacer arms 80, and particularly the outer surface 85. To the extent that the portion of cooling air 66 directed into seal cavities 63 does not completely purge cavities 63 and some of gas flow 25 enters cavity 63, spacer arms 80 can separate relatively high temperature gas flow 25 from the radially inward lower temperature cavity 60. It is desirably to reduce the amount of cooling air 66 used to purge cavities 63 and cool outer surfaces 85, since such cooling air represents a performance penalty.

Applicants have found that under engine operating conditions thermal gradients in spacer arms 80 can cause the spacer arms to distort by bowing radially outwardly, as shown in phantom in FIG. 3. The disk 40 and flanges 88 act as heat sinks, so that the central portion of the spacer arm body section 86 will be at a higher temperature than the spacer arm first and second ends 82 and 84. The spacer arm body section temperature will also increase radially outwardly from inner surface 83 (which faces relatively low temperature air in cavity 60) to outer surface 85 (which faces relatively higher temperature air in cavity 63). The resulting spacer arm distortion is detrimental. The spacer arm is a structural component that can transmit both forces and bending moments between adjacent disks, and thermal distortion of the spacer arm can result in bending stresses in the spacer arm, which are reacted at the disk rim 46.

The spacer arms 80 shown in FIG. 3 can be sized to be self supporting wheel structures which carry their own centrifugally generated hoop loads, so that support from adjacent disks is not required to carry these wheel loads. In other words, if the spacer arms were cut away from the adjacent disks to become discrete rotating components, and rotated at engine operating speeds and temperature conditions, the disk spacer arms would not burst or unacceptably deform. Accordingly, a spacer arm that is a self supporting wheel structure carries its own centrifugally generated loads, and does not react centrifugally generated loads at the adjacent disk rims. Hoop stresses generated in a rotating wheel rim are known to be proportional to the wheel mass, mean rim radius, and angular velocity squared; and inversely proportional to the cross sectional area of the rim. Given a maximum rotational speed and spacer arm material, a cross-sectional area of the spacer arm can be calculated to maintain the spacer arm stresses within the allowable range of the spacer arm material without support from the adjacent disk rims. "Formulas for Stress and Strain" by Raymond Roark and Warren Young, 5th Ed., pp. 564–572; "Theory of Elasticity" by Timoshenko and Goodier, 2nd Ed., pp. 69–73; and "Introduction to Stress Analysis" by Harris, 1959, pp. 250–260 provide a discussion of calculation of stresses in rotating disks and are incorporated herein by reference.

Figure 4:
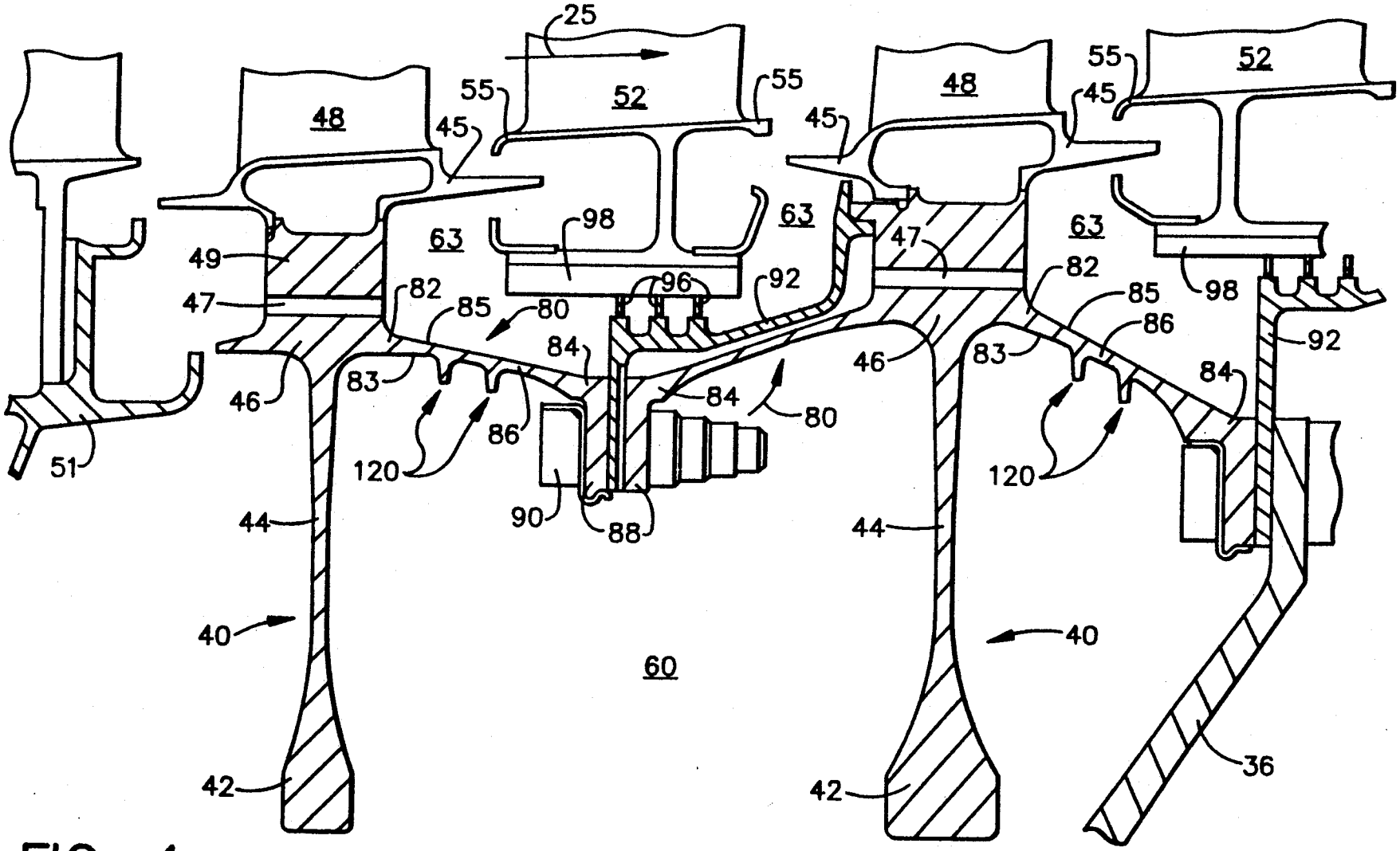
FIG. 4 is a cross-sectional schematic illustration of finned disk spacer arms in accordance with the present invention.
Figure 5:
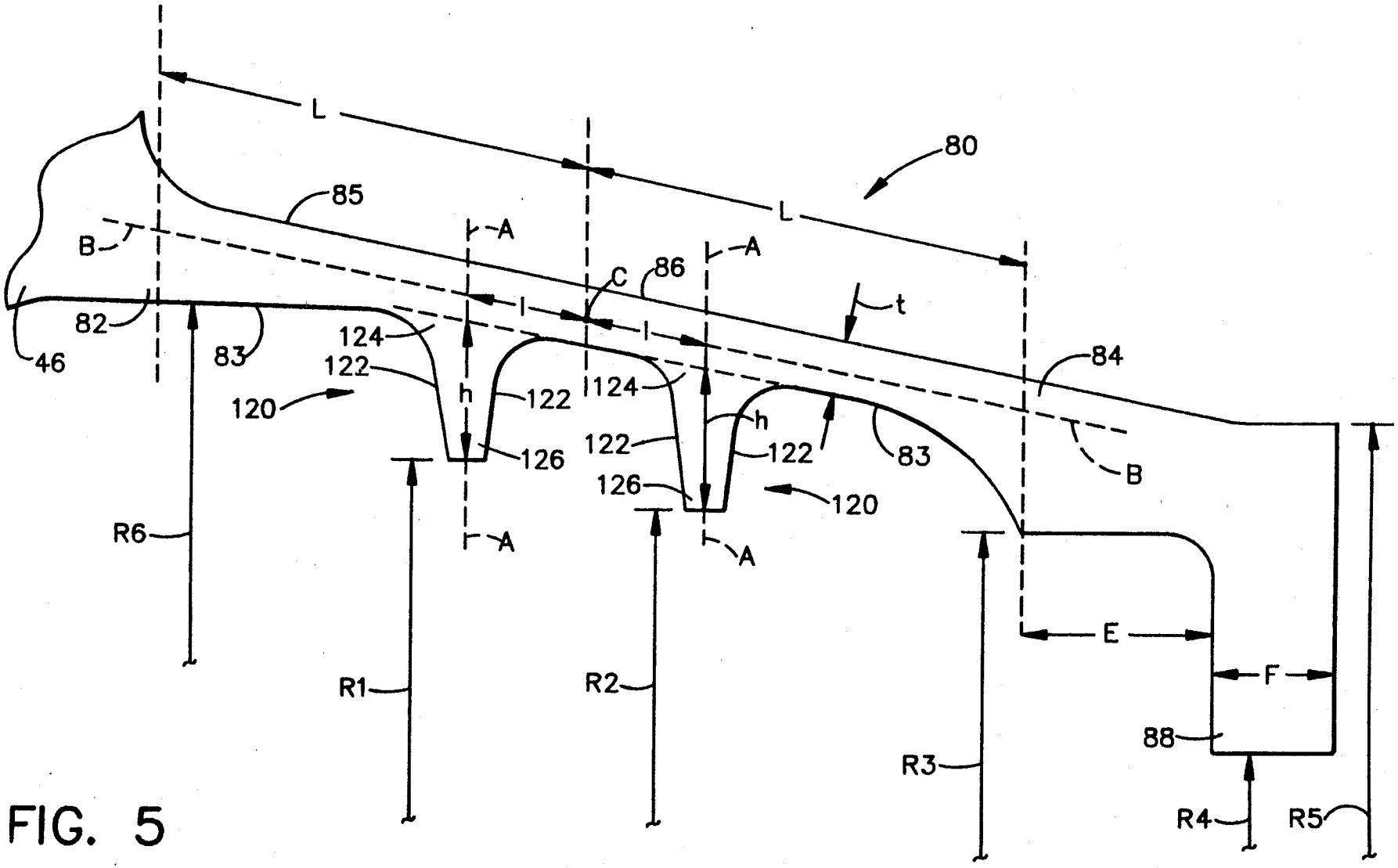
FIG. 5 is an illustration of an enlarged view of the finned disk spacer arm shown in FIG. 4.

FIGS. 4 and 5 show a preferred embodiment of the present invention. At least one, and preferably a plurality of cooling fins 120 extend from surface 83 on the spacer arm body section into the relatively lower temperature cavity 60.

Referring to FIG. 5, the fins can have tapered side walls 122 extending from a relatively thicker fin base section 124 to a relatively thinner fin tip section 126. The taper provides additional fin surface area for convective heat transfer, and allows for generous fillet radii where the sidewalls 122 are blended into spacer arm surface 83.

The fins 120 provide convective cooling for spacer arms 80. Bathing fins 120 in the cooling air 66 used to cool disk hubs 42 can promote thermal matching of the hub and fin temperatures. As described previously, thermal gradients in the spacer arm cause the spacer arm to bow radially outwardly. Applicants have found that the cooling fins can be spaced on the disk spacer arm to reduce bending stresses transmitted to the rotor disk due to the thermal gradients in the spacer arm. In FIG. 5, the midpoint c of spacer body section is located generally at a distance L from the first and second spacer arm ends 82 and 84. The disk 40 and flange 88 can act as heat sinks, so that spacer arm will be at a higher temperature at the midpoint c of the spacer arm body section, and will be at a lower temperature at the first and second ends 82 and 84. The fins 120 should be centered around the midpoint c, and preferably spaced near the midpoint c. In FIG. 5, the spacing distance 1 from the midpoint c to the fins is less than half the distance L from the midpoint to the spacer arm ends. The fin tips 126, cooled by air 66, will tend to shrink radially inwardly relative to the higher temperature spacer arm body section 86, and will resist outward bowing of the spacer arm body section.

The fins 120 are preferably circumferentially continuous so that on shrinking relative to the the spacer arm, the relatively cool tips 126 provide a 360 degree load path for tensile hoop stress. The tensile hoop stress generated in the relatively cool tips 126 resists the radially outward distortion of the spacer arms 80.

As the temperature differential between the outer spacer arm surface 85 and the fin tips 126 increases, the portion of the fins 120 carrying tensile hoop loads will increase (that is, a larger percentage of the cross-sectional area of the fins 120 will be in tension, rather than compression). Thus, as the temperature of surface 85 increases (and the differential between surface 85 and fin tips 126 increases), the fins will carry more tensile hoop load. More of the centrifugal load in the spacer arm will be carried by the fins 120, and less of the centrifugal load will be carried by body section 86. The spacer arm body section 86 can operate at a higher temperature due to the reduced load and stress in body section 86 Thus, less cooling air 66 is required to be directed through slots 47 to cool and purge cavities 63.

The fins 120 preferably extend substantially radially inward from the spacer arm, so that axis A—A of the fins is radially directed and substantially perpendicular to engine axis 14. While the fins could extend perpendicularly from surface 83, such a configuration would provide an axial offset between the base section 124 and the tip section 126, resulting in local bending stresses at the base section 126 of the fins 120 as the tips 126 shrink radially inwardly relative to arm 80.

The spacer arms 80 of FIGS. 4 and 5 are preferably self supporting wheel structures so that the added fins 120 do not load the disk rims 46 during engine operation, and so that the centrifugal loads carried by the fins 120 are not reacted at the disk rims 46. The fins 120, spacer arm 80, and disk 40 can be a unitary and integral forging from a high strength superalloy, such as Inconel 718.

An illustrative example of the relative dimensions (FIG. 5) of one embodiment of the finned structural spacer arm forming a self-supporting wheel structure follows, where the maximum rotational speed of the disk and spacer arm assembly is approximately 4000 RPM and the maximum spacer arm metal temperature is approximately 1200 degrees Fahrenheit. Lengths 1 and L can be about 0.16 inch and 0.59 inch respectively. The fin radial height h can be about 0.24 inch, and spacer arm thickness t can be about 0.07 inch. The axial width w of fin tips 126 can be about 0.05 inch, with sidewalls 122 tapered 7 to 8 degrees at the fin tips 126. Radii R1, R2, R3, R4, R5, and R6 are measured from axis 14, and can be 12.15 inch, 12.08 inch, 12.05 inch, 11.41 inch, 12.20 inch, and 12.36 inch, respectively. Axial widths E and F can be about 0.25 inch and 0.16 inch, respectively.

The fin height h is preferably substantially smaller than the radius of the fin tip, Rl or R2. The height h of fins 120 is preferably sized to develop the beneficial temperature differential between fin tip 126 and surface 85, while adding a minimal amount of weight to the spacer arm assembly. The increase in temperature differential with fin height h is non-linear, and decreases as fin height h increases. In the illustrative example above, fins with height h less than 2 percent of the respective tip radius Rl or R2 provide adequate temperature differential while adding minimal weight to the spacer arm assembly.

While this invention has been disclosed and described with respect to a preferred embodiment, it will be understood by those skilled in the art that various changes and modifications may be made without departing from the spirit and scope of the invention as set forth in the following claims.

We claim:

1. A rotor assembly for use in a gas turbine engine comprising:

a) a plurality of rotor disks, each disk supported in a cavity for rotation about an engine axis;

b) a circumferentially continuous disk spacer arm extending axially from one of the disks and adapted to transmit loads between adjacent disks; and c) a plurality of cooling fins extending from the spacer arm into the cavity, wherein said plurality of cooling fins are deployed in equal number about a midpoint of a body section of said spacer arm, wherein said plurality of cooling fins are centered about said midpoint of said body section of said spacer arm.

2. The rotor assembly recited in claim 1 wherein each cooling fin is circumferentially continuous.

3. The rotor assembly recited in claim 1, wherein the spacer arm is a self supporting wheel structure, wherein said plurality of cooling fins do not load a rim of each of said adjacent disks during operation of the gas turbine engine.

4. A rotor assembly for use in a gas turbine engine comprising:

a) a plurality of rotor disks, each disk supported in a cavity for rotation about an engine axis;

b) a circumferentially continuous disk spacer arm extending axially from one of the disks and adapted to transmit loads between adjacent disks; and c) a plurality of cooling fins extending from the spacer arm into the cavity, wherein said plurality of cooling fins are deployed in equal number about a midpoint of a body section of said arm;

d) wherein said plurality of cooling fins are positioned on the spacer arm to reduce bending stresses in the arm caused by thermal distortion of the spacer arm, wherein a distance from said midpoint of said body section of said spacer arm to any one of said fins is less than one half of a second distance from said midpoint to an end of said spacer arm.

5. A rotor assembly for use in a gas turbine engine comprising:

a) a plurality of rotor disks, each disk supported in a cavity for rotation about an engine axis;

b) a circumferentially continuous disk spacer arm extending axially from one of the disks and adapted to transmit loads between adjacent disks;

c) wherein the disk spacer arm is adapted for transmitting axial loads and bending moments between adjacent rotor disks in a gas turbine engine, the spacer arm including:

i) a spacer arm first end rigidly fixed to an adjacent rotor disk;

ii) a spacer arm second end axially spaced from the first end;

iii) a spacer arm body section extending intermediate the spacer arm first and second ends to separate a radially outward, relatively high temperature gas flow from a radially inward, relatively lower temperature cavity;

iv) a plurality of spacer arm cooling fins extending from the spacer arm body section into the lower temperature cavity; and d) wherein said plurality of spacer arm cooling fins are centered about the midpoint of the spacer arm body section.

6. The rotor assembly recited in claim 5, wherein each cooling fin is circumferentially continuous.

7. The rotor assembly recited in claim 5, wherein the spacer arm is a self supporting wheel structure.

8. The rotor assembly recited in claim 5, wherein said spacer arm and said adjacent rotor disk are made of a one-piece construction.

9. The rotor assembly recited in claim 5, wherein the adjacent rotor disk includes a rotor disk hub extending into the radially inward, relatively lower temperature cavity.

10. The rotor assembly recited in claim 5, wherein each cooling fin has tapered sidewalls extending from a relatively thicker radially outer base section to a relatively thinner radially inner tip section.

11. A rotor assembly for use in a gas turbine engine comprising:

a) a plurality of rotor disks, each rotor disk including a plurality of blades extending into a high temperature gas flow;

b) a structural disk spacer arm adapted for transmitting loads between adjacent rotor disks, the spacer arm having a first surface bounding a relatively higher temperature cavity in fluid communication with the high temperature gas flow, and the spacer arm having a second surface bounding a relatively lower temperature cavity;

c) means for directing cooling air into the relatively higher temperature cavity; and d) a plurality of cooling fins extending from the disk spacer arm into the relatively lower temperature cavity, wherein the cooling fins are centered about the midpoint of a spacer arm body section.

12. The rotor assembly recited in claim 11, wherein each cooling fin is circumferentially continuous.

13. The rotor assembly recited in claim 11, wherein the spacer arm is a self supporting wheel structure.

14. The rotor assembly recited in claim 11, wherein each cooling fin has tapered sidewalls extending from a relatively thicker radially outer base section to a relatively thinner radially inner tip section.

15. The rotor assembly recited in claim 11, wherein the spacer arm includes a first end fixedly attached to an adjacent rotor disk, and wherein the adjacent rotor disk includes a rotor disk hub extending into the relatively lower temperature cavity.

16. The rotor assembly recited in claim 11, including means for directing cooling air from the relatively lower temperature cavity to the relatively higher temperature cavity.

17. The rotor assembly as recited in claim 16, wherein the spacer arm includes a first end fixedly attached to an adjacent rotor disk, and wherein the adjacent rotor disk includes a rotor disk hub extending into the relatively lower temperature cavity.

18. A self supporting wheel structure mounted for rotation about an axis and adapted for carrying hoop loads, the structure including a body section bounding a relatively higher temperature cavity and a plurality of circumferentially continuous cooling fins extending from the structure into a relatively lower temperature cavity, wherein a temperature differential between each of said cooling fins and the body section transfers load from the body section to said cooling fins, thereby reducing the hoop loads carried by the body section, wherein said cooling fins are centered about a midpoint of said body section, each of aid fins being displaced from said midpoint by a spacing, wherein each of said spacings is less than one half of a distance from said midpoint to an end of said body section.

* * * * *